United States Patent [19]

Nakajima et al.

[11] 4,111,025

[45] Sep. 5, 1978

[54] STRAIGHTENING MILL FOR SECTION STEEL

[75] Inventors: Koe Nakajima; Hiromi Matumoto, both of Kitakyushu, Japan

[73] Assignee: Nippon Steel Corporation, Tokyo, Japan

[21] Appl. No.: 841,485

[22] Filed: Oct. 12, 1977

Related U.S. Application Data

[63] Continuation of Ser. No. 718,585, Aug. 30, 1976, abandoned, which is a continuation of Ser. No. 589,397, Jun. 23, 1975, abandoned, which is a continuation of Ser. No. 455,894, Mar. 28, 1974, abandoned.

[30] Foreign Application Priority Data

Apr. 4, 1973 [JP] Japan ..... 48/38358

[51] Int. Cl.$^2$ ..... B21D 1/02

[52] U.S. Cl. ..... 72/164

[58] Field of Search ..... 72/160–165

[56] References Cited

U.S. PATENT DOCUMENTS

| | | | |
|---|---|---|---|
| 1,003,575 | 9/1911 | Abramsen | 72/164 |
| 1,649,704 | 11/1927 | Kelley et al. | 72/164 X |
| 3,621,693 | 11/1971 | Adams | 72/164 |

*Primary Examiner*—Milton S. Mehr

*Attorney, Agent, or Firm*—Toren, McGeady and Stanger

[57] ABSTRACT

This invention relates to a straightening mill for section steel, such as I-beams, channel steel, etc., particularly to a straightening mill for section steel, wherein as the section steel is straightened so called "end crook" at the tail end thereof is eliminated. The section steel is passed through a straightening mill which comprises a plurality of driving rollers and a plurality of driven rollers defining a pass line therebetween. The axes of the driving and driven rollers are staggered and, except for the first driving roller, each of the driving rollers is fixed relative to the pass line. The driven rollers are adjustable and by proper adjustment of the first driving roller relative to the pass line, end crook is reduced or eliminated.

2 Claims, 7 Drawing Figures

STRAIGHTENING MILL FOR SECTION STEEL

This is a continuation of Application Ser. No. 718,585, filed August 30, 1976, which in turn is a continuation of Application Ser. No. 589,397, filed June 23, 1975 which in turn is a continuation of Application Ser. No. 455,894, filed on March 28, 1974, all abandoned.

BACKGROUND OF THE INVENTION

Generally, hot rolled section steels are bent to such a degree that they can not be used directly because of thermal shrinkage and the like due to nonuniformity of cooling temperature across the section of said section steel, for instance, during rolling or in the cooling process after the finish of forming, so that it is common practice to straighten said bent steel after cooling thereof by means of a straightening mill.

And, as is generally known, in the straightening mill the bent steel is passed between upper and lower straightening rollers disposed to define a pass line therebetween. By passage of the steel there-through the bent steel may be satisfactorily straightened except for the front portion and the tail portion.

But, in the vicinity of front and tail ends of the steel material to be straightened, there occurs deformation of the steel material which is different from the deformation of the intermediate portion between the ends and this is regarded as the reason why the bending which is called "end crook" remains at the front portion and the tail portion.

This "end crook" creates a difficult problem when it is desired to join together the same kinds of sections or different sections, for instance, as in the case of rails for railway trucks which are used in series. Thus, it is considered as a serious defect in the quality of the section steel, in which straightness of the top surface is considered an important quality. However, with conventional mills, repeated passes are necessary in order to deal with end crook. However, the productivity is considerably hindered, not only because of low working operation of a press, but also because secondary working is required.

SUMMARY OF THE INVENTION

The present invention is intended to eliminate this defect of the prior art and its gist consists of a straightening mill for section steel characterized in that the first driving straightening roller shaft provided on the frame of straightening mill is made movable in the vertical direction generally perpendicularly to the pass line. Namely, the device of this invention is provided with a plurality of driving straightening rollers enclosing the first driving roller, which drive the section to be straightened in the direction of the pass line, and a plurality of driven straightening rollers, which are caused to revolve through contact with the section being driven by the driving rollers. All the axes of the driving and driven rollers extend in the same direction and are generally perpendicular to the pass line. Except for the first driving roller, all the other driving rollers are provided with their axes located in a horizontal plane and are fixed in the vertical direction. The driving rollers other than the first driving roller, while fixed with regard to movement in the vertical direction, i.e. perpendicularly to the pass line, may have their axes movable within the horizontal plane. The first driving roller is arranged so that its axis is movable in the vertical direction perpendicularly to the horizontal plane where the axes of the other driving rollers are located. The adjustability of the axes of the driven rollers in the horizontal and vertical directions is the same as the adjustability of the axis of the first driving roller, with the driven rollers being located on the opposite side of the pass line relative to the driving rollers.

The object of this invention is to provide a straightening mill for section steel featuring improved productivity, which is capable of producing high quality section steel without requiring any subsequent straightening after an initial path straightening the bends of the section steel. The invention achieves this object by eliminating the bending in the tail portion, of the section steel.

DESCRIPTION OF THE PREFERRED EMBODIMENTS

Figure 1:
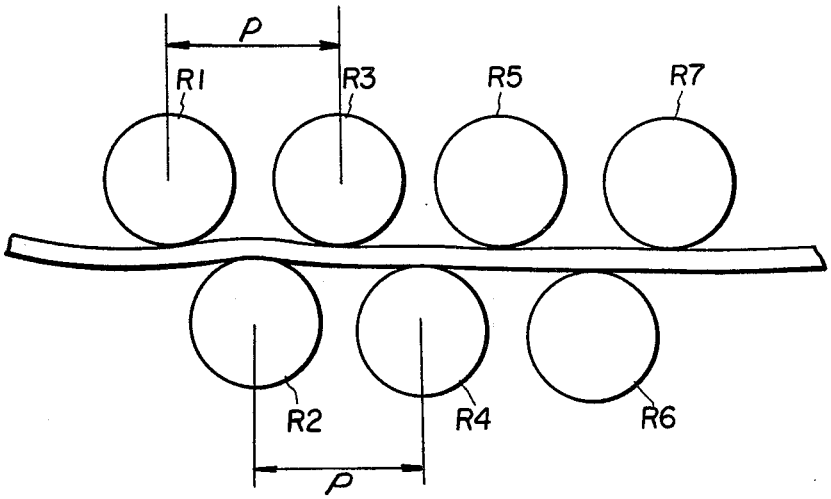
FIG. 1 is an explanatory drawing, showing general arrangement of rollers in a straightening mill for section steel.

To explain the invention in connection with the cause for occurrence of "end crook" in the usual method, deformation process of the section steel to be straightened in the usual roller straightening will be described on the basis of drawings. In FIG. 1 there is shown a general arrangement of rollers for a straightening mill in accordance with the present invention. The straightening mill of the invention shown in FIG. 1 includes a first driving roller R1 and second, third and fourth driving rollers which are identified respectively as R3, R5, and R7. Located below the driving rollers are a plurality of driven rollers identified as R2, R4 and R6 with R2 being the first driven roller. The second and third driven rollers are, respectively, R4 and R6. The rollers shown in FIG. 1 are arranged so that their centers are spaced apart an interval P with both the driving rollers R1, R3, R5 and R7 and the driven rollers R2, R4 and R6 having their respective centers spaced from the adjacent roller an interval P. Thus, in the description which follows, it may be assumed that the intervals between both the driving rollers and the driven rollers is equally set to a distance P, and that each driven roller is arranged with its center located at a position taken perpendicularly of the pass line intermediate the centers of the two neighboring driving rollers. That is, the center of the roller R2 is located intermediate the centers of the rollers R1 and R3. The center of the roller R3 is located intermediate the centers of the rollers R2 and R4, and the center of the roller R4 is located intermediate the centers of the rollers R3 and R5. As will be apparent, the same arrangement of roller centers applies with the other rollers depicted in FIG. 1. In the specific embodiment shown in FIG. 1, each roller is located with its center about one half the distance between the centers of the neighboring rollers located on the opposite side of the pass line. It should be understood that this arrangement is set forth primarily for the purposes of convenience of explanation and in the description which follows it will be clarified that the invention is also applicable to a case where the rollers are not arranged with their centers located at equal intervals from the centers of neighboring rollers on the opposite side of the pass line. In any event, it should be understood that the rollers of the invention are to be arranged with their axes in staggered relationship relative to the axes of the rollers on the opposite side of the pass line.

Figure 2:
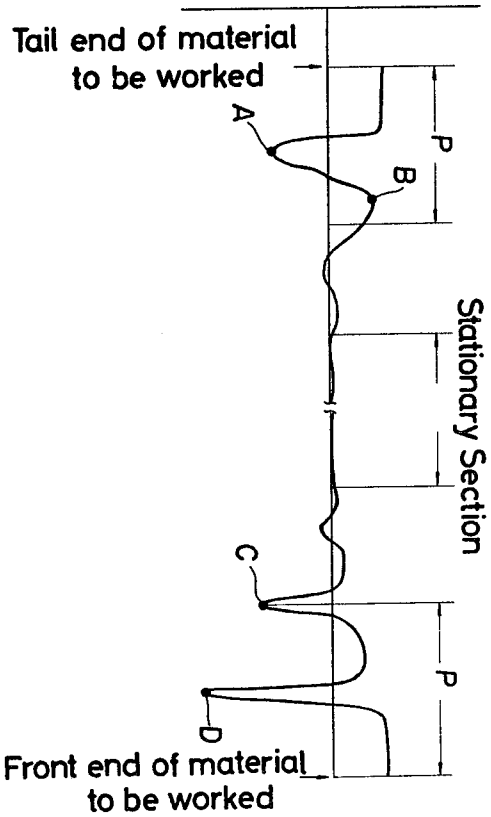
FIG. 2 is a diagram of residual curvature in a section steel straightened by usual straightening mill.

The basic operating principles of the present invention will be explained by reference to the mechanism involving the occurrence of "end crook" and with reference particularly to FIG. 2. As will be apparent from FIG. 1, the section steel which is passed through the rollers includes a leading end which is first passed between the rollers along the pass line and a trailing end which is last passed through the pass line between the rollers. The end crook which is to be eliminated or prevented is particularly that which will occur at the trailing end of the section steel. As shown in FIG. 2, approximately one-half roller interval length ($\frac{1}{2}$ P) extending immediately adjacent the leading end and also extending immediately adjacent the trailing end of the section steel will be subjected to no plastic deformation during the straightening process. Indeed, the curvatures of these portions immediately adjacent the leading and the trailing ends of the section steel before straightening become directly the curvatures after straightening. Additionally, it will be seen that the curvatures of portions of the section steel extending over one roller interval length (P) extending from both ends of the section steel are considerably different from the curvature at the intermediate portion between the end portions.

The large curvature at approximately one-half roller interval from the leading end of the straightened section steel corresponding to the point D in FIG. 2 is the result of localized and repeated bendings effected in such a manner that when the leading end contracts, for example, the roller R3, a small portion in contact with the roller R2 will be suddenly bent and when the leading end contacts with the roller R4 a small portion contacting with the roller R3 will be suddenly bent in the opposite direction. This, by way of example, will describe the general operation which occurs as the section steel passes through the pass line during the straightening operation. The large degree of curvature which occurs at approximately one roller interval from the leading end of the section steel corresponding to the point C shown in FIG. 2 is the result of localized and repeated bending occurring at this point when the point D contacts the rollers. However, bending at the leading end of the section steel is similar to the bending which occurs at the intermediate portion, in view of the relationship which exists between the degree of bending and the setting condition of the rollers, although the deformation at the leading end portion occurs locally. Therefore, the end crook at the leading end portion may be avoided by a suitable setting of the rollers.

But, the occurence mechanism of "end crook" at the tail end portion of the straightened section steel, which the present invention intends to solve, is different from that of "end crook" at the front end thereof. Namely, the "end crook" of the tail end portion of the straightened section steel is characterized, as seen in FIG. 2, by a non-deformed portion having approximately one half roller interval length ($\frac{1}{2}$P) of tail end portion of the steel and a bending of portion A and a reverse bending of portion B. Said bending of portion A is nearly the same as the bending of steel immediately after it is bent by the roller $R_2$ in deformation progress received by the intermediate portion of the steel to be straightened, and similarly said bending of portion B is nearly the same as the bending of steel immediately after it is bent by the roller $R_3$. Namely while the intermediate portion of the steel receives repeated bending action by the straightening rollers of the later stage, i.e. on and after $R_4$ to $R_7$, as well to be straightened into straight or nearly straight shape, said tail end portion does not receive bending after the tail end of the steel has passed under $R_1$ roller, so that the point A does not receive bending by the rollers after $R_2$ and the point B does not receive bending by the rollers after $R_3$.

As mentioned above, nonuniformity of the distribution of the curvature of the front end portion or the tail end portion of the straightened section steel will inevitably occur during roller straightening, the elimination of bending at tail end portion is a particularly troublesome matter. Namely, for instance, when the tail end portion of the straightened steel is bent upwards it is necessary for straightening such a bent portion to enlarge the bending at the portion A in FIG. 2 or to lessen the bending at the portion B therein. However, if it is assumed that the stroke of the roller R2 in the upward direction is made relatively large for the purpose of enlarging the bending at the point A, namely the bending by the roller R2, then there results at the same time the effect that the bending at the point B, namely the bending by the roller R3, will be made large because the relative positions of the rollers R2, R3, R4 will be changed so that the top surface shape of one roller interval (P) extending from the trailing or tail end is not improved from the point of view of the straightness of the entire length of the section steel.

An important characteristic of the present invention resides in the fact that the bendings at the points A, B, may be changed independently, an achievement which is not possible with conventional mills for reasons previously discussed. That is, with the present invention which provides that the roller R1 is movable in a vertical direction or in a direction extending generally perpendicularly to the pass line, the straightening mill is made capable of selecting the appropriate ending which occurs at the points A, B through an appropriate setting of the rollers. This consideration will be clear from the criteria of the roller settings. If, for example, one-half roller interval length ($\frac{1}{2}$P) from the trailing or tail end is bent upwardly so that it becomes necessary to enlarge the bending at the point A, then the appropriate roller setting would be to lower the roller R1, thereby changing the relative positioning of the rollers R1, R2, R3 without changing the relative positioning of the rollers R2, R3, R4. On the other hand, if a one roller interval length (P) from the trailing end is bent upwardly so that it becomes necessary to reduce the bending at the point B, then the appropriate roller setting would be to lower the roller R1 and at the same time to lower the roller R2, while maintaining unchanged the relative positioning of the rollers R1, R2, R3 and changing the relative positioning of the rollers R2, R3, R4.

Figure 3:
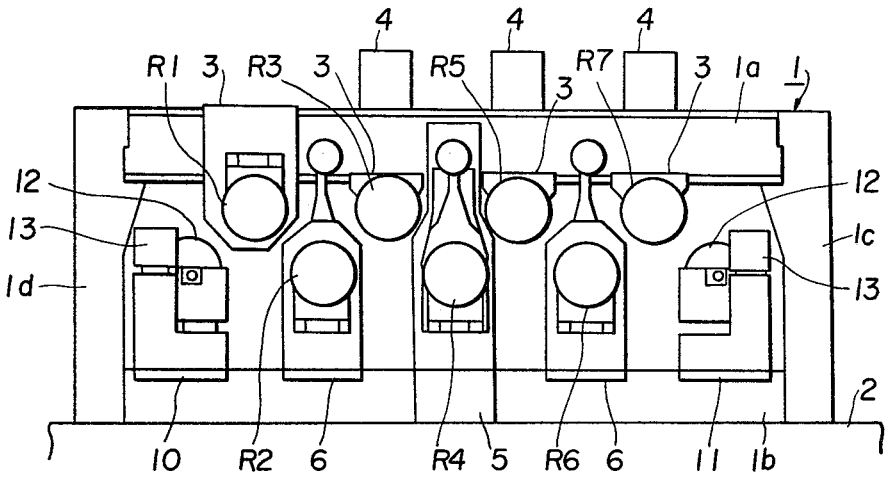
FIG. 3 is a schematic front view showing an embodiment of this invention.
Figure 4:
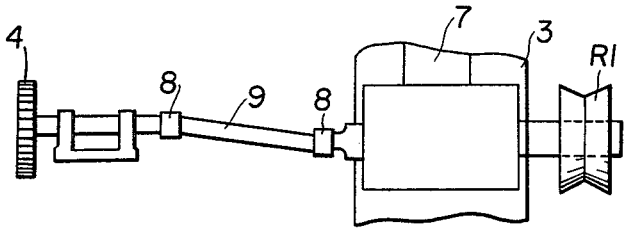
FIG. 4 is a schematic side view showing main part of this invention and being an embodiment of rolling and lifting mechanism for the first driving straightening roller.

FIG. 3 is an embodiment, showing a construction according to this invention and a schematic front view, and FIG. 4 is an embodiment, showing a rolling and lifting mechanism of the first driving straightening roller and a schematic side view.

In the drawings, 1 is a machine frame (hereinafter called frame) of the straightening machine, comprising upper frame 1*a*, lower frame 1*b* and side frames 1*c*, 1*d* and rigidly mounted on a bed plate 2.

$R_1$, $R_3$, $R_5$ and $R_7$ are driving straightening rollers and are suspended by the sliding portions of the upper frame 1*a* through moving frames 3, mounted with variable roller pitch through variable roller pitch shafts (not shown), which are provided passing through said moving frames 3, and respectively connected with driving means 4.

On the other hand, $R_2$, $R_4$ and $R_6$ are driven straightening rollers, wherein the roller $R_4$ is received by a fixed frame 5 and each of rollers $R_2$, $R_6$ is received by a moving frame 6 respectively, and said moving frames 6 are provided on the lower frame 1*b* with variable roller pitch through variable roller pitch shafts (not shown). The rollers $R_2$, $R_4$ and $R_6$ are provided in a vertically movable state by means of, for instance, motor or hydraulic transmission system within the frames 5 and 6.

All of the driving straightening rollers $R_1$ to $R_7$ and the driven straightening rollers $R_2$ to $R_6$ are movable in the direction of roller shaft by means of driving means such as a motor driving system.

As shown in FIG. 4, the roller $R_1$ is vertically movable within the moving frame 3 by moving means 7 of a motor or hydraulic transmission system, and it is connected through universal couplings 8 and a constant speed spindle 9, with the driving means of the roller $R_1$, which is provided on an appropriate position of the frame 1 of the straightening machine, in a vertically movable state with variable roller pitch.

The rolling and transmission means of the roller $R_1$ is not always limited to the above mentioned one, but may be suitably selected and used if said roller $R_1$ may be provided in a vertically movable state with variable roller pitch.

10 and 11 are receiving roller stands provided movable in the direction of pass line respectively on inlet and outlet sides of the roller straightening machine, and they comprise horizontal rollers 12 and a pair of vertical rollers 13 which are respectively provided in a position adjustable state.

The effect of straightening in case of section steel is straightened by means of above mentioned mill arrangement will be described in reference to some examples.

Figure 5:
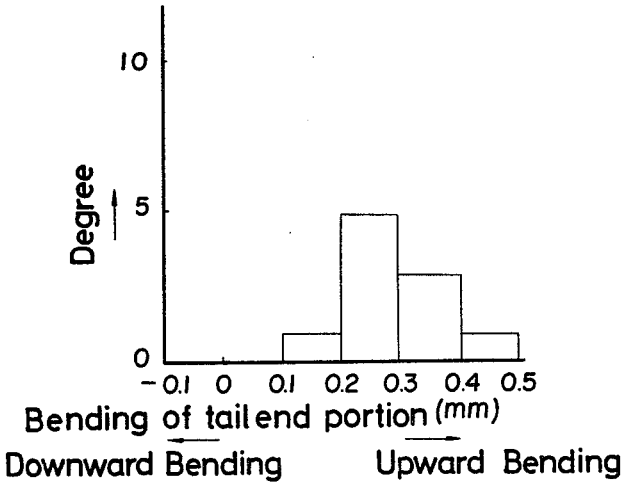
FIG. 5 is a diagram showing the degree of bending residue at the tail end portion in case of the first driving straightening roller is not used for setting of the bending.
Figure 6:
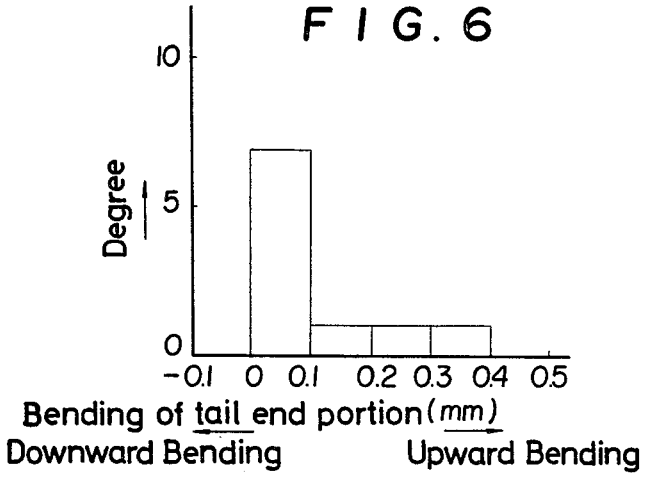
FIG. 6 is a diagram showing the degree of bending residue at tail end portion in case said roller is set for medium reduction.
Figure 7:
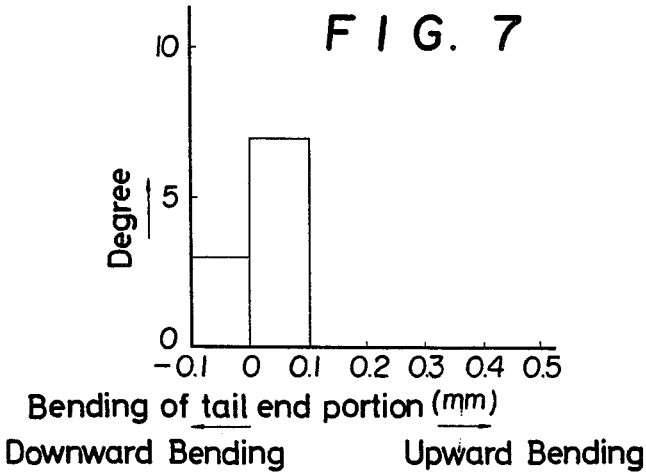
FIG. 7 is a diagram showing the degree of bending residue at tail end portion in case said roller is set for appropriate reduction.

FIGS. 5–7 are graphs wherein there is plotted on the ordinate of each the degree of bending and wherein there is plotted on the abscissa the location along the tail end portion where such degree of bending occurs.

FIG. 5 shows the degree of residue of the bending at the tail end portion in case the first driving straightening roller $R_1$ is not used for setting the roller pressure, i.e. in case the section steel is straightened by setting the rollers according to the usual method, and FIG. 6 shows the degree of residue of the bending at the tail end portion in case the section steel is straightened by setting the roller $R_1$ at a pressure of medium degree (about $\frac{1}{2}$ of the appropriate rolling pressure), and proves that the present invention is effective in the straightening of tail end portion even under such a condition.

Further, FIG. 7 shows the degree of residue of the bending at the tail end portion in case the section steel is straightened by setting the roller $R_1$ at the appropriate rolling pressure.

The rail which is the object of the example is 60 kg rail under the most strict standard, and the effect of straightening, i.e. the residual amount of bending is measured about ten examples respectively.

Referring to FIG. 5, those having the largest residual amount of bending are found on the upper limit, and in practical production, there is naturally involved some risk that non-standardized products, i.e. rejected articles due to large amount of bending will be frequently encountered.

On the contrary, in case the present invention is applied as shown in FIG. 7, it is apparent that the amount of bending remains in the section steel is very small and the bending is close to zero value, thus the steel is shaped to an approximately straight condition having almost no bending at the tail end.

The present invention is arranged as mentioned above, and upon its application, "end crook" of the section steel, particularly the bending of tail end portion may be eliminated merely by roller straightening, thus taking very large effect on the improvement of productivity which is requiring high efficiency of straightening operation and disuse of secondary straightening, as well as the problem of ununiformity of curvature at front and tail end portions, which can not be solved by the second straightening process by press and the like, may be solved at once, so that section steel of high quality, which can keep the straightness over whole length or within allowable limit thereof, may be provided.

Further, when the first driving straightening roller is enabled to set the pressure in cooperation with the first driven straightening roller, the deformation process of the intermediate portion of the section steel, which is usually subject to the influence of setting of pressure merely by the first driven straightening roller, may be reasonably effected, so as to contribute to the improvement of accuracy of straightening. And, there is such an effect that the section steel is smoothly enguazed by the roller straightening mill by making the first driving straightening roller movable vertically.

What is claimed is:

1. In a roller straightening mill for effecting straightening of section steel passed therethrough, said section steel having a leading end and a trailing end and being passed through said mill with said leading end first, said mill operating to prevent end crook from occurring in said trailing end of said section steel during said straightening, said mill including a plurality of driving rollers each rotatable about an axis and a plurality of driven rollers each rotatable about an axis, with said axes of said driving and driven rollers being parallel to each other, said plurality of driving rollers being spaced from said plurality of driven rollers to define therebetween a pass line through which said section steel may be passed between said rollers in a predetermined direction, each of said plurality of driving rollers being located on one side of said pass line and each of said plurality of the driven rollers being located on the opposite side thereof, with the axes of said driving rollers being arranged in staggered relationship relative to the axes of said driven rollers, said plurality of driving rollers including a first driving roller located relative to said pass line to be engaged first by the leading end of section steel through said pass line in said predetermined direction, each of said driving rollers other than said first driving roller being mounted in a fixed position with regard to vertical movement of the axes thereof relative to said pass line, the improvement comprising adjustment means for adjustably moving said first driving roller in directions extending generally perpendicular to said pass line and for positioning said first driving roller relative to said pass line prior to passage of said section steel through said roller mill, said adjustment means being adapted to effect said moving and positioning to a degree in accordance with the amount of end crook to be removed from said trailing end of said section steel.

2. A method for effecting straightening of section steel having a leading end and a trailing end, and for preventing end crook from occurring in said trailing end during said straightening by passing said section steel through a roller straightening mill with said leading end first, said mill including a plurality of driving rollers each rotatable about an axis, and a plurality of driven rollers each rotatable about an axis, with said axes of said driving and driven rollers being parallel to each other, said plurality of driving rollers being spaced from said plurality of driven rollers to define therebetween a pass line through which said section steel may be passed between said rollers in a predetermined direction, each of said plurality of driving rollers being located on one side of said pass line and each of said plurality of driven rollers being located on the opposite side thereof, with the axes of said driving rollers being arranged in staggered relationship relative to the axes of said driven rollers, said plurality of driving rollers including a first driving roller located relative to said pass line to be engaged first by section steel passed through said pass line in said predetermined direction, each of said driving rollers other than said first driving roller being mounted in a fixed position with regard to vertical movement of the axes of said driving rollers relative to said pass line, said method comprising the steps of determining the amount of end crook in said trailing end of said section steel prior to passage of said section steel through said roller mill, adjustably moving said first driving roller in directions extending generally perpendicularly to said pass line to position said first driving roller relative to said pass line in accordance with the amount of end crook to be removed from said trailing end of said section steel, and passing said section steel through said roller mill along said pass line with said leading end first.

* * * * *